US012239267B2

(12) United States Patent
Giarritta

(10) Patent No.: US 12,239,267 B2
(45) Date of Patent: Mar. 4, 2025

(54) FOUR-DIRECTION SCRUBBING CARPET SHAMPOOER

(71) Applicant: Mark Jeffery Giarritta, Foresthill, CA (US)

(72) Inventor: Mark Jeffery Giarritta, Foresthill, CA (US)

( * ) Notice: Subject to any disclaimer, the term of this patent is extended or adjusted under 35 U.S.C. 154(b) by 414 days.

(21) Appl. No.: 16/916,935

(22) Filed: Jun. 30, 2020

(65) Prior Publication Data

US 2021/0000317 A1 Jan. 7, 2021

Related U.S. Application Data

(60) Provisional application No. 62/869,602, filed on Jul. 2, 2019.

(51) Int. Cl.
*A47L 11/30* (2006.01)
*A47L 11/32* (2006.01)
(Continued)

(52) U.S. Cl.
CPC ..... *A47L 11/302* (2013.01); *A47L 11/325* (2013.01); *A47L 11/34* (2013.01); *A47L 11/4016* (2013.01);
(Continued)

(58) Field of Classification Search
CPC ..... A47L 11/302; A47L 11/34; A47L 5/365; A47L 9/0081; A47L 9/106; A47L 9/1625;
(Continued)

(56) References Cited

U.S. PATENT DOCUMENTS 573,922 A 12/1896 Ridge
594,395 A 11/1897 Graetz
(Continued)

FOREIGN PATENT DOCUMENTS

DE 102017106419 A1 * 9/2018 ..... A47L 11/24
JP H03202032 12/1989
KR 101514201 B1 * 11/2013

OTHER PUBLICATIONS

Translation of KR101514201B1 (Year: 2022).*
(Continued)

*Primary Examiner* — Edward F Landrum
*Assistant Examiner* — Sarah Akyaa Fordjour
(74) *Attorney, Agent, or Firm* — Inventive Law Inc.; Jim H. Salter

(57) ABSTRACT

A four-direction carpet shampooer is disclosed. Example embodiments include: a first brush configured to rotate on a first axis; a second brush configured to rotate on a second axis, the second axis being different from the first axis; a direction of travel sensor to detect the shampooer direction of travel; and a rotation changing actuator configured to reverse the rotation of the first brush on the first axis and to reverse the rotation of the second brush on the second axis when the direction of travel sensor indicates the shampooer direction of travel has changed. Example embodiments also include a shampooer cleaning station comprising: a first brush configured to rotate on a first axis; a second brush configured to rotate on a second axis, the second axis being different from the first axis; and a hair grinding system including protrusions configured to remove hair from a brush roll of a carpet shampooer, and a grinder to grind up the hair and dispose the ground-up hair into a waste water reservoir.

15 Claims, 10 Drawing Sheets

(51) Int. Cl.
*A47L 11/34* (2006.01)
*A47L 11/40* (2006.01)

(52) U.S. Cl.
CPC ..... *A47L 11/4069* (2013.01); *A47L 11/4083* (2013.01); *A47L 11/4088* (2013.01)

(58) Field of Classification Search
CPC .... A47L 9/1641; A47L 9/1683; A47L 9/2857; A47L 11/325; A47L 11/4016; A47L 11/4041; A47L 11/4069; A47L 11/4083; A47L 11/4088; A47L 11/18; A47L 11/19; A47L 11/24; A47L 11/282; A47L 11/292; A47L 9/0477; A47L 11/08; A47L 11/14; A46B 17/06; A46B 13/001; A46B 13/02; A46B 2200/3033; A46B 9/02
USPC ..... 15/374, 384, 340.4
See application file for complete search history.

(56) References Cited

U.S. PATENT DOCUMENTS 720,791 A 2/1903 Draver
907,014 A 12/1908 Dunn
1,161,700 A 11/1915 Lazar
1,200,995 A 10/1916 Smarlin
1,222,436 A 4/1917 Mason
1,240,799 A 9/1917 Gray
1,268,963 A 6/1918 Gray
1,720,165 A 7/1929 Nathan
1,736,446 A 11/1929 Keefer
1,752,882 A 4/1930 Boutwell
1,813,325 A 7/1931 Smith
1,820,350 A 8/1931 Dance
1,872,602 A 8/1932 Olsen
1,907,692 A 5/1933 White
1,965,614 A 7/1934 Sellers
1,999,696 A 4/1935 Kitto
2,008,376 A 7/1935 White
2,032,345 A 3/1936 Cranon
2,049,603 A 8/1936 Dietenberger
2,064,587 A 12/1936 Fredrik
2,138,239 A 11/1938 Irgens
2,200,026 A 5/1940 Juelson
2,217,617 A 10/1940 Conway
2,542,634 A 2/1951 Davis
2,625,698 A 1/1953 Kadt
2,642,601 A 6/1953 Saffioti
2,642,617 A 6/1953 Lilly
2,660,457 A 11/1953 Mallon
2,663,045 A 12/1953 Conway
2,698,672 A 1/1955 Burnside
2,703,903 A 3/1955 Johan
2,731,659 A 1/1956 George
2,733,000 A 1/1956 Sparklin
2,741,785 A 4/1956 Siebert
2,789,306 A 4/1957 Kath
2,904,818 A 9/1959 Sheahan
2,960,714 A 11/1960 Senne
2,975,450 A 3/1961 Edgar
2,980,392 A 4/1961 Greenwood
2,999,258 A 9/1961 Edward
3,011,206 A 12/1961 Karl
3,268,936 A 8/1966 Hiroshi
3,331,090 A 7/1967 Reiber
3,425,192 A 2/1969 Davis
3,444,577 A 5/1969 Koland
3,469,470 A * 9/1969 Gaudry ..... F16H 55/14 15/52
3,470,575 A 10/1969 Larson
3,605,786 A 9/1971 Machin
3,631,558 A * 1/1972 Kovacevic ..... A47L 11/4069 15/384
3,644,960 A 2/1972 Danzig
3,655,328 A 4/1972 Sando
3,671,996 A 6/1972 Gaudry
3,683,444 A 8/1972 Schaefer
3,688,339 A 9/1972 Conway
3,722,018 A 3/1973 Fisher
3,792,707 A 2/1974 Tupper
3,851,349 A 12/1974 Lowder
3,862,467 A 1/1975 Krickovic
3,863,285 A 2/1975 Hukuba
3,924,285 A * 12/1975 Hukuba ..... A47L 11/4036 15/49.1
3,928,884 A 12/1975 Sutter
3,947,911 A 4/1976 Meyerhoefer
3,996,640 A 12/1976 Blue
4,000,538 A 1/1977 Tissier
4,014,067 A 3/1977 Bates
4,020,526 A 5/1977 Johansson
4,025,984 A 5/1977 Hoener, Jr.
4,084,283 A 4/1978 Rosendall
4,153,968 A 5/1979 Perkins
4,158,248 A 6/1979 Palmer
4,171,208 A 10/1979 Lowder
4,171,554 A 10/1979 Tschudy
4,173,054 A 11/1979 Ando
4,179,768 A 12/1979 Sawyer
4,193,710 A 3/1980 Pietrowski
4,209,872 A 7/1980 Maier
4,242,396 A 12/1980 Wilson
4,295,243 A 10/1981 King
4,317,253 A 3/1982 Gut
4,329,756 A 5/1982 Chicoine
4,348,783 A 9/1982 Swanson
4,352,221 A 10/1982 Revells
4,353,145 A 10/1982 Woodford
4,370,690 A 1/1983 Baker
4,370,777 A 2/1983 Woerwag
4,372,004 A 2/1983 Vermillion
4,373,228 A 2/1983 Dyson
4,377,017 A 3/1983 Herpers
4,398,231 A 8/1983 Currence
4,426,751 A 1/1984 Nordeen
4,429,432 A 2/1984 Copeland
4,464,810 A 8/1984 Karpanty
4,490,873 A 1/1985 Stratton
4,554,700 A 11/1985 Lyman
4,558,484 A 12/1985 Groth
4,558,823 A 12/1985 Groth
4,564,972 A 1/1986 Varin
4,570,856 A 2/1986 Groth
4,573,235 A 3/1986 Baird, Sr.
4,654,924 A 4/1987 Getz
4,679,152 A 7/1987 Perdue
4,702,122 A 10/1987 Richard
4,741,069 A 5/1988 Helm
4,763,293 A 8/1988 Takei
4,776,060 A 10/1988 Chang
4,797,969 A 1/1989 Caduff
4,802,254 A 2/1989 Lahndorff
4,805,258 A 2/1989 Sitarski
4,809,397 A 3/1989 Jacobs
4,817,233 A 4/1989 Waldhauser
4,841,595 A 6/1989 Wiese
4,847,944 A 7/1989 Lackner
4,875,246 A 10/1989 Macgregor
4,881,288 A 11/1989 May
4,893,375 A 1/1990 Girman
4,920,605 A 5/1990 Takashima
4,940,082 A 7/1990 Roden
4,953,253 A 9/1990 Fukuda
4,956,891 A 9/1990 Wulff
4,989,293 A 2/1991 Bashyam
4,991,730 A 2/1991 Pehr
5,018,240 A * 5/1991 Holman ..... A47L 5/30 15/384
5,048,141 A 9/1991 Huppi
5,067,861 A 11/1991 Danielsen
5,075,922 A 12/1991 Tsuchida
5,088,149 A 2/1992 Berg
5,115,538 A 5/1992 Cochran
5,121,592 A 6/1992 Jertson

(56) References Cited

U.S. PATENT DOCUMENTS 5,129,125 A 7/1992 Gamou
5,180,439 A 1/1993 Allison
5,182,834 A 2/1993 Wright
5,203,047 A 4/1993 Lynn
5,243,732 A 9/1993 Koharagi
5,287,581 A 2/1994 Lo
5,299,608 A 4/1994 Bosyj
5,394,588 A 3/1995 Kweon
5,406,673 A 4/1995 Bradd
5,452,490 A 9/1995 Brundula
5,482,562 A 1/1996 Abernathy
5,483,726 A 1/1996 Blase
5,500,977 A 3/1996 Mcallise
5,566,422 A 10/1996 Geyer
5,608,945 A 3/1997 Crouser
5,630,246 A 5/1997 Knowlton
5,634,693 A 6/1997 Heuvelman
D381,477 S 7/1997 Ingram
5,657,503 A 8/1997 Caruso
5,657,504 A 8/1997 Khoury
5,692,808 A 12/1997 Heuvelman
5,697,509 A 12/1997 Hayes
5,698,957 A 12/1997 Sowada
5,867,857 A 2/1999 Crouser
5,871,152 A 2/1999 Saney
5,937,475 A 8/1999 Kasen
5,974,622 A 11/1999 Louis
5,974,975 A 11/1999 Seefried
5,991,972 A 11/1999 Krebs
6,030,465 A 2/2000 Marcussen
6,042,656 A 3/2000 Knutson
6,090,221 A 7/2000 Gan
6,105,203 A 8/2000 Hueppi
6,108,862 A 8/2000 Frederick
6,123,779 A 9/2000 Conrad
6,131,237 A 10/2000 Kasper
6,131,238 A 10/2000 Weber
6,134,744 A 10/2000 Kasen
6,145,159 A 11/2000 Zahuranec
6,158,081 A 12/2000 Kasen
6,167,586 B1 1/2001 Reed, Jr.
6,170,119 B1 1/2001 Conrad
6,247,202 B1 6/2001 Lesco
6,253,414 B1 7/2001 Bradd
6,266,838 B1 7/2001 Caruso
6,279,196 B2 8/2001 Kasen
6,282,749 B1 9/2001 Tajima
6,286,180 B1 9/2001 Kasper
6,289,552 B1 9/2001 Mccormick
6,289,553 B1 9/2001 Dyson
6,300,306 B1 10/2001 Firkins
6,351,872 B1 3/2002 Mccormick
6,367,120 B2 4/2002 Beauchamp
6,389,329 B1 5/2002 Colens
6,446,302 B1 9/2002 Kasper
6,453,507 B1 9/2002 Gilbert
6,481,048 B1 * 11/2002 Hauff ..... A47L 7/0038 15/410
6,502,277 B1 1/2003 Petersson
6,533,871 B2 3/2003 Zahuranec
6,539,575 B1 4/2003 Cohen
6,539,577 B1 4/2003 Okuda
6,605,156 B1 8/2003 Clark
6,658,692 B2 12/2003 Lenkiewicz
6,671,925 B2 1/2004 Field
6,681,442 B2 1/2004 Coates
6,684,452 B2 2/2004 Lehman
6,721,990 B2 4/2004 Zahuranec
6,807,707 B2 10/2004 Park
6,810,559 B2 11/2004 Mertes
6,842,942 B2 1/2005 Morgan
6,866,603 B2 3/2005 Ackerman
6,883,201 B2 4/2005 Jones
6,892,420 B1 5/2005 Haan
7,039,985 B2 5/2006 Hisrich
7,069,620 B2 7/2006 Bagwell
7,100,234 B2 9/2006 Weber
7,143,461 B2 12/2006 Spooner
7,159,276 B2 1/2007 Omoto
7,163,568 B2 1/2007 Sepke
7,171,723 B2 2/2007 Kobayashi
7,228,593 B2 6/2007 Conrad
7,237,298 B2 7/2007 Reindle
7,243,393 B2 7/2007 Matusz
7,251,858 B2 8/2007 Hitzelberger
7,281,297 B2 10/2007 Peacock
7,290,308 B2 11/2007 Downey
7,293,326 B2 11/2007 Hawkins
7,299,521 B2 11/2007 Theiss, Jr.
7,367,083 B2 5/2008 Barker
7,475,450 B1 * 1/2009 Ragner ..... A47L 11/4069 15/384
7,533,442 B2 5/2009 Morgan
7,600,521 B2 10/2009 Woo
7,617,563 B2 11/2009 Hertrick
7,627,927 B2 12/2009 Blocker
7,628,831 B2 12/2009 Gomiciaga-pereda
7,631,392 B1 12/2009 Meitz
7,718,593 B2 5/2010 Micciche
7,722,709 B2 5/2010 Conrad
7,731,618 B2 6/2010 Burlington
7,757,340 B2 7/2010 Sawalski
7,770,255 B2 8/2010 Zahuranec
7,784,148 B2 8/2010 Lenkiwicz
7,895,706 B2 3/2011 Mitchell
7,930,799 B2 4/2011 Sutton
7,931,716 B2 4/2011 Oakham
7,931,717 B2 4/2011 Conrad
7,996,956 B2 8/2011 Wood
8,042,224 B2 10/2011 White
8,048,183 B2 11/2011 Conrad
8,051,531 B2 11/2011 Brough
8,087,117 B2 1/2012 Kapoor
8,100,999 B2 1/2012 Ashbee
8,132,288 B2 3/2012 Dawson
8,292,979 B2 10/2012 Conrad
8,351,736 B2 1/2013 Demandolx
8,387,206 B2 3/2013 Arthey
8,387,207 B2 3/2013 Dimbylow
8,418,303 B2 4/2013 Kapoor
8,468,647 B2 6/2013 Lambourn
8,510,908 B2 8/2013 Maguire
8,544,145 B2 10/2013 Arthey
8,567,009 B2 10/2013 Krebs
8,601,643 B2 12/2013 Eriksson
8,671,515 B2 3/2014 Eriksson
8,800,106 B2 8/2014 Bilek
8,819,892 B1 9/2014 Mangum
8,826,680 B2 9/2014 Crane
9,072,416 B2 7/2015 Kowalski
9,186,030 B2 11/2015 Jung
9,226,941 B2 1/2016 Cooksey
9,314,140 B2 4/2016 Eriksson
9,427,128 B2 8/2016 Dejonge
9,549,648 B2 1/2017 Lenkiewicz, Jr.
9,615,708 B2 4/2017 Kowalski
9,693,663 B2 7/2017 Kasper
9,717,389 B2 8/2017 Johnson
9,820,624 B2 11/2017 Eriksson
9,820,626 B2 11/2017 Eriksson
10,059,118 B2 8/2018 Sato
10,105,024 B2 10/2018 Kasper
10,130,235 B2 11/2018 Caro, Jr.
10,165,916 B2 1/2019 Morphey
10,165,917 B2 1/2019 Miller
10,168,709 B2 1/2019 Kleiner
10,182,696 B2 1/2019 Dehn
10,188,252 B2 1/2019 Nguyen
2001/0002500 A1 6/2001 Kasen
2001/0054213 A1 12/2001 Oh
2002/0007528 A1 1/2002 Beauchamp
2002/0092115 A1 7/2002 Zahuranec
2002/0092116 A1 7/2002 Zahuranec
2002/0092122 A1 7/2002 Zahuranec

(56) References Cited

U.S. PATENT DOCUMENTS

2002/0170137 A1 11/2002 Coates
2003/0037409 A1 2/2003 Lee
2003/0051309 A1 3/2003 Morgan
2003/0110588 A1 6/2003 Zahuranec
2003/0135952 A1 7/2003 Coates
2003/0188396 A1 10/2003 Hitzelberger
2003/0196294 A1 10/2003 Conrad
2004/0000023 A1 1/2004 Hitzelberger
2004/0010884 A1 1/2004 Hitzelberger
2004/0025270 A1 2/2004 Mitchell
2004/0134024 A1 7/2004 Allen
2004/0172769 A1 9/2004 Giddings
2004/0172784 A1 9/2004 Downey
2004/0181888 A1 9/2004 Tawara
2004/0216265 A1 11/2004 Peacock
2004/0244140 A1 12/2004 Joo
2005/0015916 A1 1/2005 Orubor
2005/0015922 A1 1/2005 Lim
2005/0034266 A1 2/2005 Morgan
2005/0044657 A1 3/2005 Shanor
2005/0091788 A1 5/2005 Forsberg
2005/0155169 A1 7/2005 Cheah
2005/0160555 A1 7/2005 Mayes
2005/0160556 A1 7/2005 Hitzelberger
2005/0172447 A1 8/2005 Roney
2006/0000053 A1 1/2006 Lim
2006/0060216 A1 3/2006 Woo
2006/0070206 A1 4/2006 Fischer
2006/0076035 A1 4/2006 Mcgee
2006/0101604 A1 5/2006 Frederick
2006/0101612 A1 5/2006 Gordon
2006/0156498 A1 7/2006 Venard
2006/0213025 A1 9/2006 Sawalski
2006/0236492 A1 10/2006 Sudo
2006/0288516 A1 12/2006 Sawalski
2007/0017062 A1 1/2007 Overvaag
2007/0144193 A1 6/2007 Crane
2007/0234492 A1 10/2007 Svendsen
2007/0261193 A1 11/2007 Gordon
2008/0196193 A1 8/2008 Huffman
2008/0230083 A1 9/2008 Williams
2009/0095699 A1 4/2009 Milante
2009/0165822 A1 7/2009 Kintz
2009/0265878 A1 10/2009 Bilek
2012/0047677 A1 3/2012 Paliobeis
2013/0139349 A1* 6/2013 Iles ..... A47L 9/04 15/383
2014/0245560 A1 9/2014 Huang
2014/0289983 A1 10/2014 Gilbert, Jr.
2015/0000705 A1 1/2015 Dehn
2015/0375272 A1 12/2015 Dehn
2016/0324385 A1 11/2016 Lenkiewicz
2016/0353957 A1 12/2016 Dejonge
2016/0367096 A1 12/2016 Kasper
2016/0367097 A1 12/2016 Moyher, Jr.
2016/0367101 A1 12/2016 Haley
2017/0000305 A1 1/2017 Gordon
2017/0071434 A1 3/2017 Nguyen
2017/0100006 A1 4/2017 Lenkiewicz
2017/0113234 A1 4/2017 Endo
2017/0119223 A1 5/2017 Staf
2017/0119225 A1 5/2017 Xia
2017/0127901 A1 5/2017 Huang
2017/0141040 A1 5/2017 Yu
2017/0172363 A1 6/2017 Eriksson
2017/0188768 A1 7/2017 Song
2017/0215665 A1 8/2017 Vantongeren
2017/0217176 A1 8/2017 Sato
2017/0231445 A1 8/2017 Kasper
2017/0296021 A1 10/2017 Li
2017/0296023 A1 10/2017 Qiao
2017/0297455 A1 10/2017 Romanov
2017/0360267 A1 12/2017 Jenson
2017/0371341 A1 12/2017 Leinhos
2018/0008114 A1 1/2018 Caro, Jr.
2018/0035606 A1 2/2018 Burdoucci
2018/0074508 A1 3/2018 Kleiner
2018/0078103 A1 3/2018 Vantongeren
2018/0078107 A1 3/2018 Gagnon
2018/0092499 A1 4/2018 Strazisar
2018/0098675 A1 4/2018 Sauer
2018/0110388 A1 4/2018 Xia
2018/0125315 A1 5/2018 Kasper, Jr.
2018/0168419 A1 6/2018 Johnson
2018/0177374 A1 6/2018 Nguyen
2018/0184863 A1 7/2018 Kasper
2018/0185530 A1 7/2018 Ronda
2018/0199780 A1 7/2018 Landry
2018/0213987 A1 8/2018 Hong
2018/0221920 A1 8/2018 Piwonka-corle
2018/0229255 A1 8/2018 Pruiett
2018/0236663 A1 8/2018 Cohen
2018/0249875 A1 9/2018 Hooley
2018/0255991 A1 9/2018 Der Marderosian
2018/0263454 A1 9/2018 Landry
2018/0281191 A1 10/2018 Sinyavskiy
2018/0284792 A1 10/2018 Kleiner
2018/0289231 A1 10/2018 Santini
2018/0292828 A1 10/2018 Jones
2018/0296046 A1 10/2018 Thorne
2018/0297208 A1 10/2018 Goel
2018/0303300 A1 10/2018 Kasper
2018/0317728 A1 11/2018 Tomlinson
2018/0325341 A1 11/2018 Xia
2018/0333845 A1 11/2018 Williams
2018/0338654 A1 11/2018 Kelsey
2018/0338656 A1 11/2018 Carter
2018/0339409 A1 11/2018 Williams
2018/0339410 A1 11/2018 Williams
2018/0344112 A1 12/2018 Krebs
2018/0344114 A1 12/2018 Scholten
2018/0368646 A1 12/2018 Buehler
2019/0000286 A1 1/2019 Kasper
2019/0008348 A1 1/2019 Conrad
2019/0021565 A1 1/2019 Fester
2019/0045996 A1 2/2019 Caro, Jr.
2019/0053680 A1 2/2019 Schultheis
2019/0059665 A1 2/2019 Krebs
2019/0059671 A1 2/2019 Conrad
2019/0059679 A1 2/2019 Huffman
2019/0061160 A1 2/2019 Fisher
2019/0069739 A1 3/2019 Miller
2019/0069743 A1 3/2019 Spencer
2019/0223678 A1* 7/2019 Park ..... A47L 11/405

OTHER PUBLICATIONS

Translation of DE-102017106419-A1 (Year: 2022).*
PCT International Search Report and Written Opinion, PCT International Appl. No. PCT/US2020/40435, International Filing Date: Jul. 1, 2020, Applicant: Mark Jeffery Giarritta, mailed Nov. 9, 2020.
PCT International Preliminary Report on Patentability, PCT International Appl. No. PCT/US2020/040435, International Filing Date: Jul. 1, 2020, Applicant: Mark Jeffery Giarritta, mailed Dec. 28, 2021.

* cited by examiner

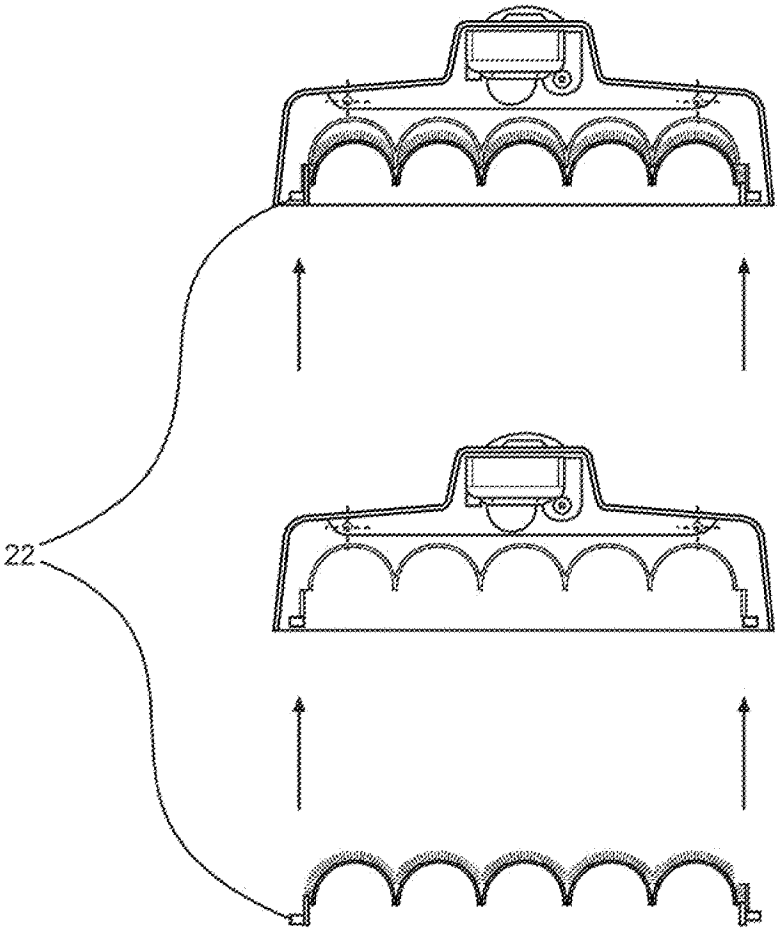
FIG. 12
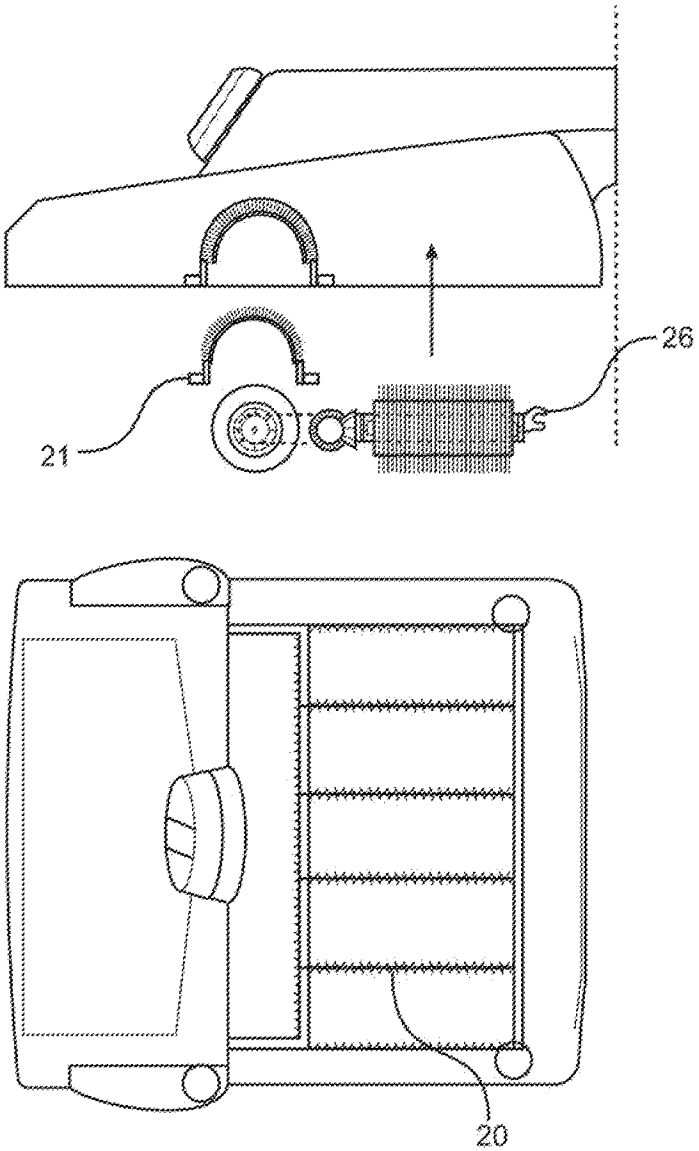

FOUR-DIRECTION SCRUBBING CARPET SHAMPOOER

PRIORITY PATENT APPLICATION

This non-provisional patent application draws priority from U.S. provisional patent application Ser. No. 62/869,602; filed Jul. 2, 2019. The entire disclosure of the referenced patent application is considered part of the disclosure of the present application and is hereby incorporated by reference herein in its entirety.

COPYRIGHT

A portion of the disclosure of this patent document contains material that is subject to copyright protection. The copyright owner has no objection to the facsimile reproduction of the patent document or the patent disclosure, as it appears in the U.S. Patent and Trademark Office patent files or records, but otherwise reserves all copyright rights whatsoever. The following notice applies to the disclosure provided herein and to the drawings that form a part of this document: Copyright 2018-2020, Mark Jeffery GIARRITTA; All Rights Reserved.

TECHNICAL FIELD

The disclosed subject matter relates to carpet shampooers and floor cleaners, and more particularly to a four-direction carpet shampooer.

BACKGROUND

Typical cleaner designs have one roller brush that rotates vertically and spins in one direction; thus, it essentially only cleans one vertical face/side of the carpet fiber and at least partially the top when traveling in one path forward and back. This means that to shampoo all four faces or sides of the carpet fiber, the carpet shampooer would have to run forward and backward in four directions to thoroughly scrub all four sides of the carpet fibers. This would be extremely time consuming and hard on the equipment.

Another conventional design provided two brush rolls running parallel and both rotating opposite directions. This would work a little better, but would still only clean two sides of the carpet fiber in a forward and backward motion of the shampooer or cleaner. To thoroughly scrub the carpet, it would still require excessive work having to run the machine in multiple directions to scrub all sides of the carpet fibers.

A third conventional design implements the original long brush and a second row of horizontally rotating flat brushes in an effort to clean more sides of the carpet fibers. However, this design loses some of its cleaning ability; because, the parallel opposing rotation brush roll is removed to insert the flat brushes. The flat bushes while spinning strike around the sides of some of the carpet fibers; but this design runs a risk of damaging the carpet fibers with the twisting motion and still is not effectively cleaning all sides of the carpet.

SUMMARY

There is disclosed herein various example embodiments of a four-direction scrubbing shampooer. In the various example embodiments described herein, this new four-direction scrubbing shampooer design is an improvement of existing shampooers and floor cleaner technology. One purpose of my new four-direction scrubbing carpet shampooer is to be able to clean all four vertical faces of the carpet fibers, in one path of travel, and one pass forward and backwards. The new design can be implemented in any shampooer, vacuum and floor buffing system, etc., as a stand-alone unit or an attachment. This in no way constitutes a limitation of use or application. The disclosed process and brush design can be employed in any cleaning system. Thus, the disclosed design is useful in any cleaning application. The various example embodiments are described in more detail below.

BRIEF DESCRIPTION OF THE DRAWINGS

Embodiments are illustrated by way of example and not limitation in the figures of the accompanying drawings, in which:

FIG. 12 illustrates an example embodiment showing the brush cleaning waste water troughs, the brush roll housing cleaning brush (long brush), the brush roll housing cleaning brush (short brushes), and the attachment hooks;

DETAILED DESCRIPTION

Figure 1:
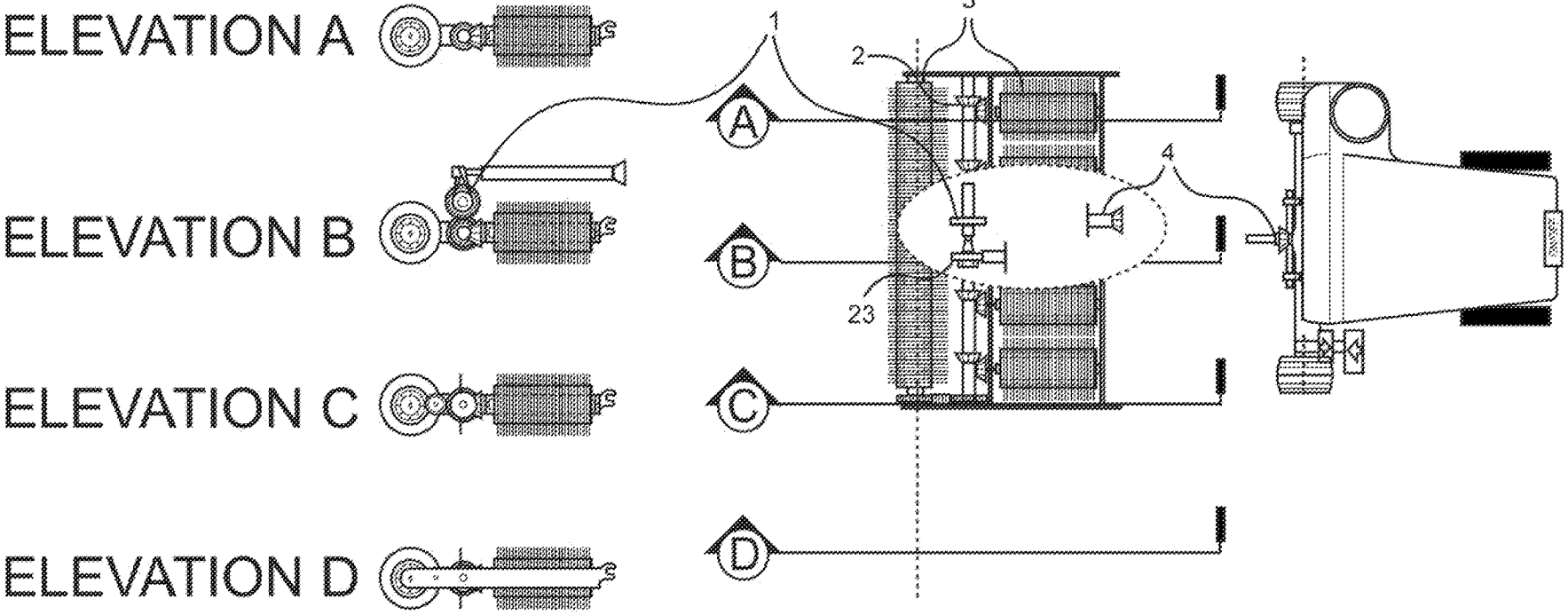
FIG. 1 illustrates an example embodiment showing a spindle gear, an idler arm, brush rolls, and a bevel gear.

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

There is disclosed herein various example embodiments of a four-direction scrubbing shampooer. In the various example embodiments described herein, this new four-direction scrubbing shampooer design is an improvement of existing shampooers and floor cleaner technology. One purpose of my new four-direction scrubbing carpet shampooer is to be able to clean all four vertical faces of the carpet fibers, in one path of travel, and one pass forward and backwards. The new design can be implemented in any shampooer, vacuum and floor buffing system, etc., as a stand-alone unit or an attachment. This in no way constitutes a limitation of use or application. The disclosed process and brush design can be employed in any cleaning system. Thus, the disclosed design is useful in any cleaning application or non-cleaning application into which the disclosed design can be incorporated.

In a particular example embodiment, a conventional circular dry foam shampooer head or any foam shampooer can be used to help describe the new design. The circular dry foam shampooer head can retain the original head shape, but it will be extended longer in the rear to accommodate a new row of brush rolls. The original vertically rotating brush roll stays in the same general position with approximately five new vertically rotating short brush rolls, positioned parallel to each other in the opposing direction of the original long brush. The additional brushes will be the same shape, diameter and design as the existing brush roll, but shorter at approximately 4"-6" long (See Item 3, FIG. 1). The existing brush roll will retain its original connectors to hook into the shampooer head, while at the same time being connected to the brush array frame rail (See item 6, FIG. 2). Along with the existing long brush, all five opposing short brushes will be connected to the rail, making all brushes into a single removable brush array (See item 6, FIG. 2), that keeps all brushes in perfect alignment for easy removal and installation for maintenance. The brushes can be permanently attached to the rail, or can be attached to the rail with a connector on each end, so if one of the brushes is damaged, it can be replaced. Additionally, the brushes can be inserted in, or connected to the cleaning device head singly or in any connected combination, instead of as an array.

How it Works

As described above, two sets of brushes clean in opposing directions simultaneously, which cleans two vertical faces/sides of the carpet fibers. The shampooer cleans all four sides of the carpet fibers by using the following process: when the shampooer is traveling forward all brushes are spinning/rotating one direction, cleaning two vertical faces of the carpet fibers. When the user starts pulling the shampooer backwards, all brushes change their direction of rotation and spin to a reverse direction, thus cleaning the other two faces of the carpet fibers. In this manner, all four sides of the carpet fibers are cleaned in one stroke forwards and backwards of the shampooer, in one path of travel.

How the Brush Rolls are Driven

There are numerous ways that the brushes can be driven, such as:

1. All brushes are driven separately by belts, gears, worm drive, air suction or blower, or an alternate driving component, by motor, transmission, air pump, or alternative driving source.
2. The cleaning unit can use brush rolls with motors inside of them, each operating independently, with cooling fans and gearing for operation. In this application the motor and brush roll are coaxial.
3. The row of short brushes can be all connected and can be run simultaneously via a belt, air suction or blower, worm drive, or an alternative driving component with the long brush separately propelled, all propelled by a motor, transmission or alternative driving source.
4. Some combination of above.
5. All brushes can be driven simultaneously from the same source.

Figure 7:
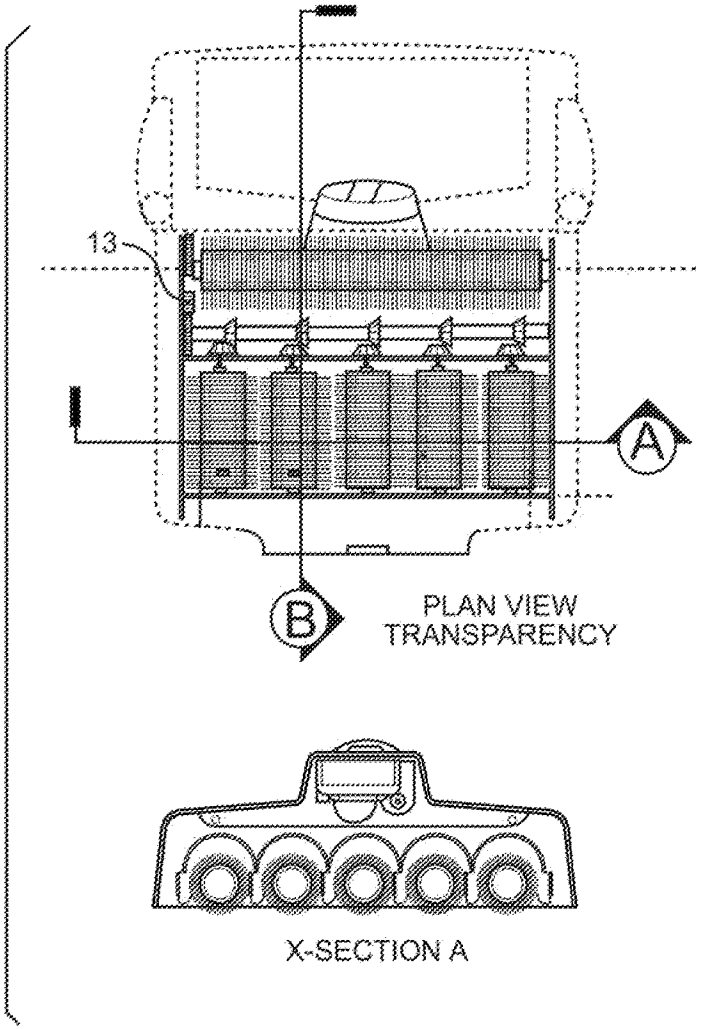
FIG. 7 illustrates an example embodiment showing a gap spanning gear.

In an alternative example embodiment, all five brushes can be propelled from a single source. This is achieved by using the following process:

1. provide an idler arm (See item 2, FIG. 1) running in between the long brush and the row of short brushes.
2. provide a bevel gear on the end of each short brush, with a corresponding bevel gear on the idler arm.
3. provide a straight or bevel gear on the end of the long brush, a gear in between to span the gap (See item 13, FIG. 7), and a corresponding gear on the idler arm.
4. With this alignment, the one idler arm propels all brush rolls at the same time, driven by one propulsion source.

Figure 2:
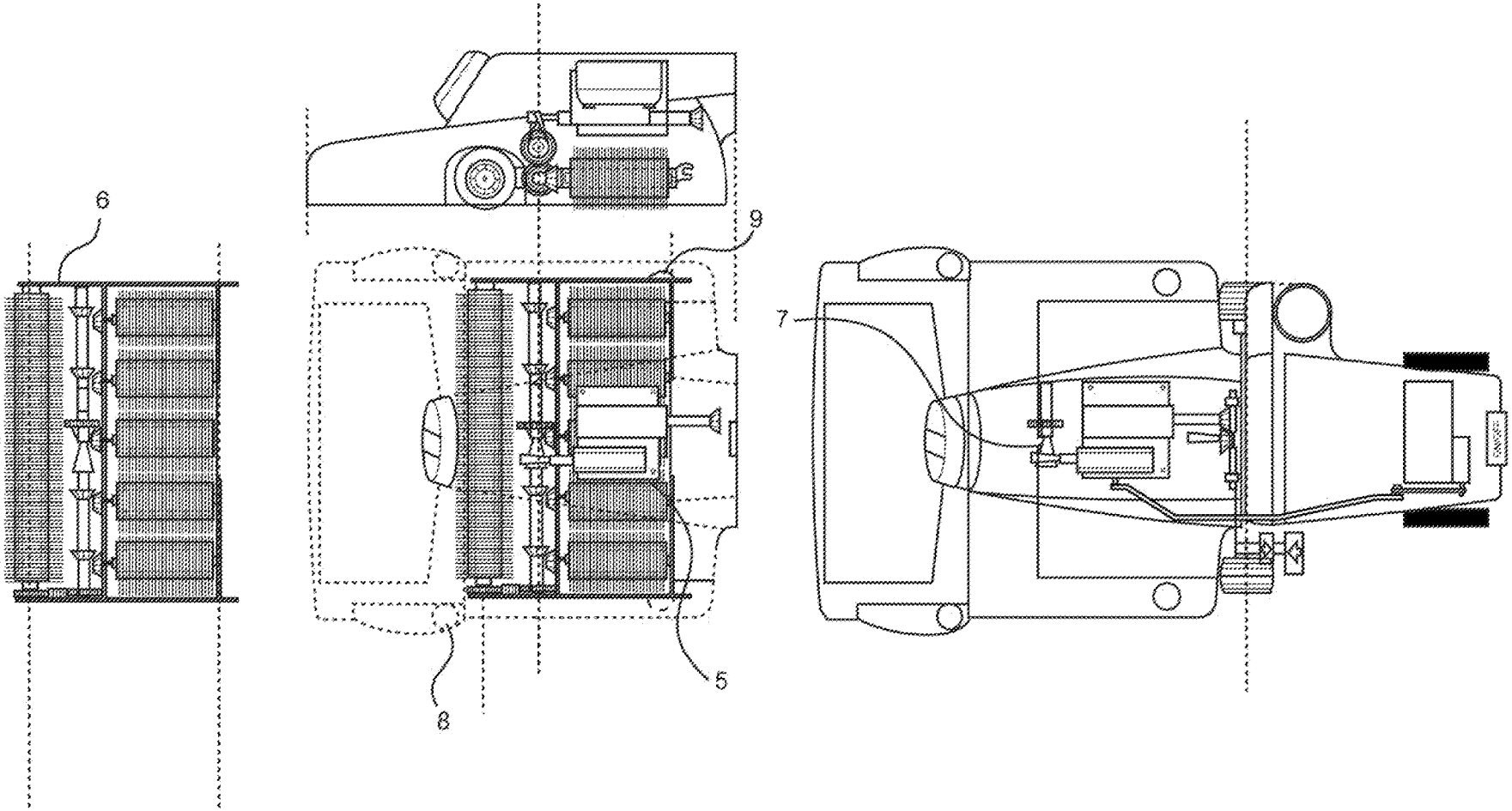
FIG. 2 illustrates an example embodiment showing a transmission, a brush array frame rail, a belt, a foam output port from a soap bottle, and an air intake port to the soap bottle.

Near the center of the idler arm, aligned with the drive spindle, one more gear is provided, with a corresponding gear above that has a spindle attached or (spindle gear) (See item 1, FIG. 1). The belt (See item 7, FIG. 2) connects to the spindle gear of the idler arm and above to the drive spindle (See item 23, FIG. 1) of either a transmission or a motor (See item 5, FIG. 2), to propel and change direction of brush rotation. Drive can be achieved with less ease of belt changing by having to disconnect the idler arm to slide the belt around it to connect directly, removing the spindle gear.

Figure 3:
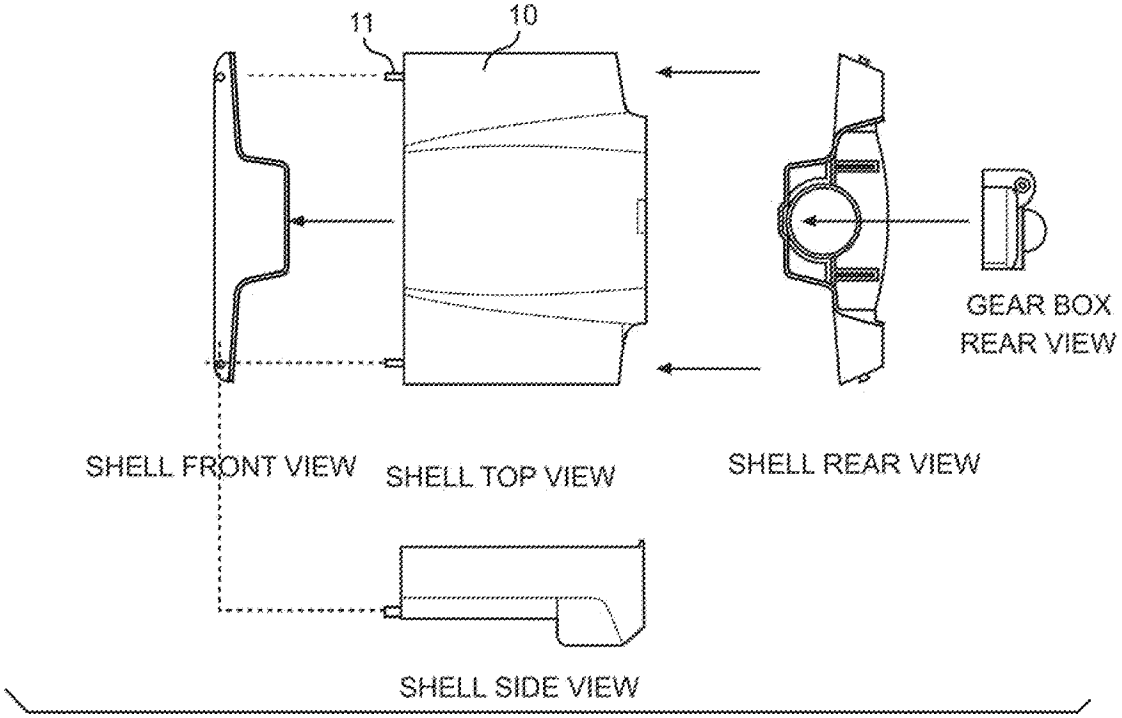
FIG. 3 illustrates an example embodiment showing a transmission/motor shell and attachment dowels.

The spindle gear is important for two reasons:

1. The conventional design required a user to disassemble the machine and take out the brush roll, to slide the belt around the brush roll, to install the belt. Customers many times had trouble disassembling the machine, which was discouraging. The extra spindle gear allows the user to install the belt without disassembling the inner workings of the head, only needing to remove the transmission/motor shell (See item 10, FIG. 3), wrap the belt around the spindle gears spindle, use the belt lifter to grab and lift belt, slide back on the transmission/motor shell and turn belt lifter to lower belt onto transmission/motor output spindle, making belt installation much easier.
2. Having the extra spindle gear above the idler arm also makes it possible to put a protective and sound dampening casing (not illustrated) around the idler arm and gears, which can quiet the gear noise, and can be sealed to keep moisture and most importantly sand and grit out of the gears. To accomplish full seal, the casing can completely surround the spindle gear as well as the idler arm and long brush gears as two halves assembled around the gears and the idler arm. This allows the belt to be connected without the belt going through the protective casing, which would create an opening for dirt and moisture.

The gears, the entire brush array frame rail, the entire shampooer base, and the transmission/motor shell can be constructed of any type of material, such as: wood, metal, plastic, composite or alternatively material.

Figure 10:
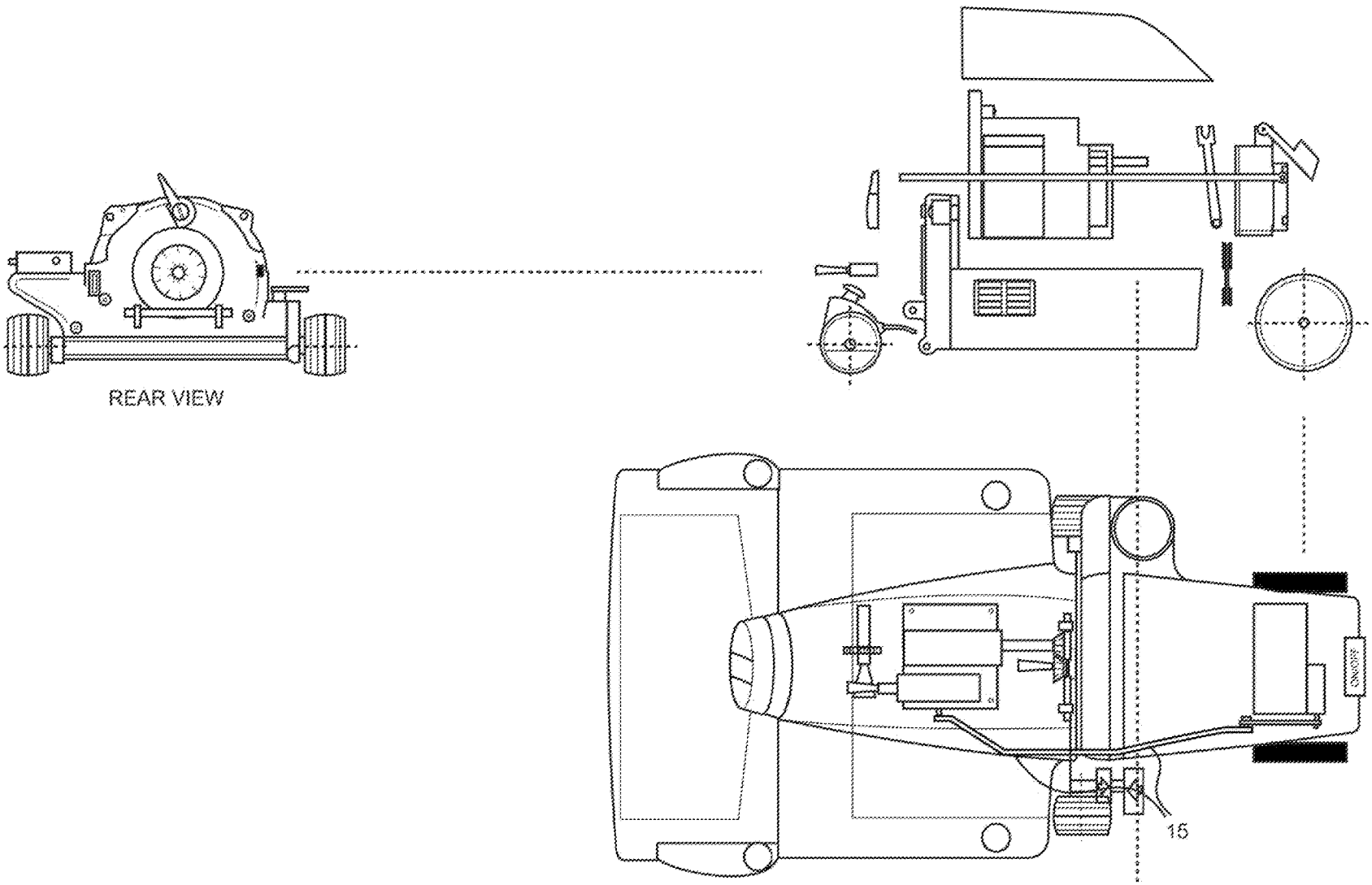
FIG. 10 illustrates an example embodiment showing a mechanical actuation arm.

To execute the changing of brush rotation direction, an actuator either mechanical, electric, or computerized, can run off the handle. A direct mechanical arm could be used for sensing a direction of travel (See item 15, FIG. 10). A wheel sensor could be implemented to detect the direction the shampooer or device is traveling and change the direction of brush rotation when the machine's direction of travel changes. Alternatively, a scanning or motion sensor can be used to detect the direction of travel.

The rotation changing actuator can have a delay built in to slow down the brushes to near or complete stop before the brush rotation direction changes. Also, it is possible to have the drive motor or transmission incrementally increase and decrease power to the brushes below and back to normal operating levels during rotation transition for varying cleaning tasks and or at turning machine on or off. The motor can also have varying operation speeds for different cleaning tasks to conserve energy, if necessary.

In the case of a machine that employs attachments, a transmission (See item 5, FIG. 2) may be necessary to facilitate drive and rotation direction change from the power plant to the brushes. With the transmission changing the rotation direction, the power plant can function normally and rotate constantly in one direction. In this case, we use a bevel gear (See item 4, FIG. 1) on the input shaft of the transmission to be propelled by the corresponding bevel gear (See item 4, FIG. 1) of the power plant's output shaft. The transmission can be connected to the power plant by some other means, but the above-described gearing is the simplest method.

The changing of the brush rotation can also be achieved with the brushes being propelled directly by a motor. The motor can reverse polarity and itself rotate in the opposite direction, when the path of travel actuator or sensor signals a change in the direction of travel and brush rotation. There can also be two separate motors propelling in opposite directions, taking turns propelling to achieve both directions of brush rotation. One motor propelling brush rotation one direction when the machine is traveling forward and one motor propelling brush rotation in the opposite direction when the machine is traveling backwards.

Any combination of motors, transmissions, belts, gears, air suction or blower, worm drives or the like can be used to achieve this four-direction carpet scrubbing process. Any combination mentioned would still constitute the same process. This description is not suggesting limitations to this design. This process of having two opposite orientations of vertically rotating brushes, changing direction of brush rotation based on the direction the machine is traveling, to clean four sides of the carpet fibers, is not limited to the enclosed descriptions. Any arrangement of brush size, orientation, drive method or directional method will still constitute this same new process. For instance, if the brushes were turned diagonally and changed brush rotation direction based on direction of travel of the machine, or if a user used horizontally rotating brushes, in any number or orientation, with or without also having a vertically rotating brush also and had them change rotation direction based on direction of travel of the machine, it would still be the same process.

Figure 13:
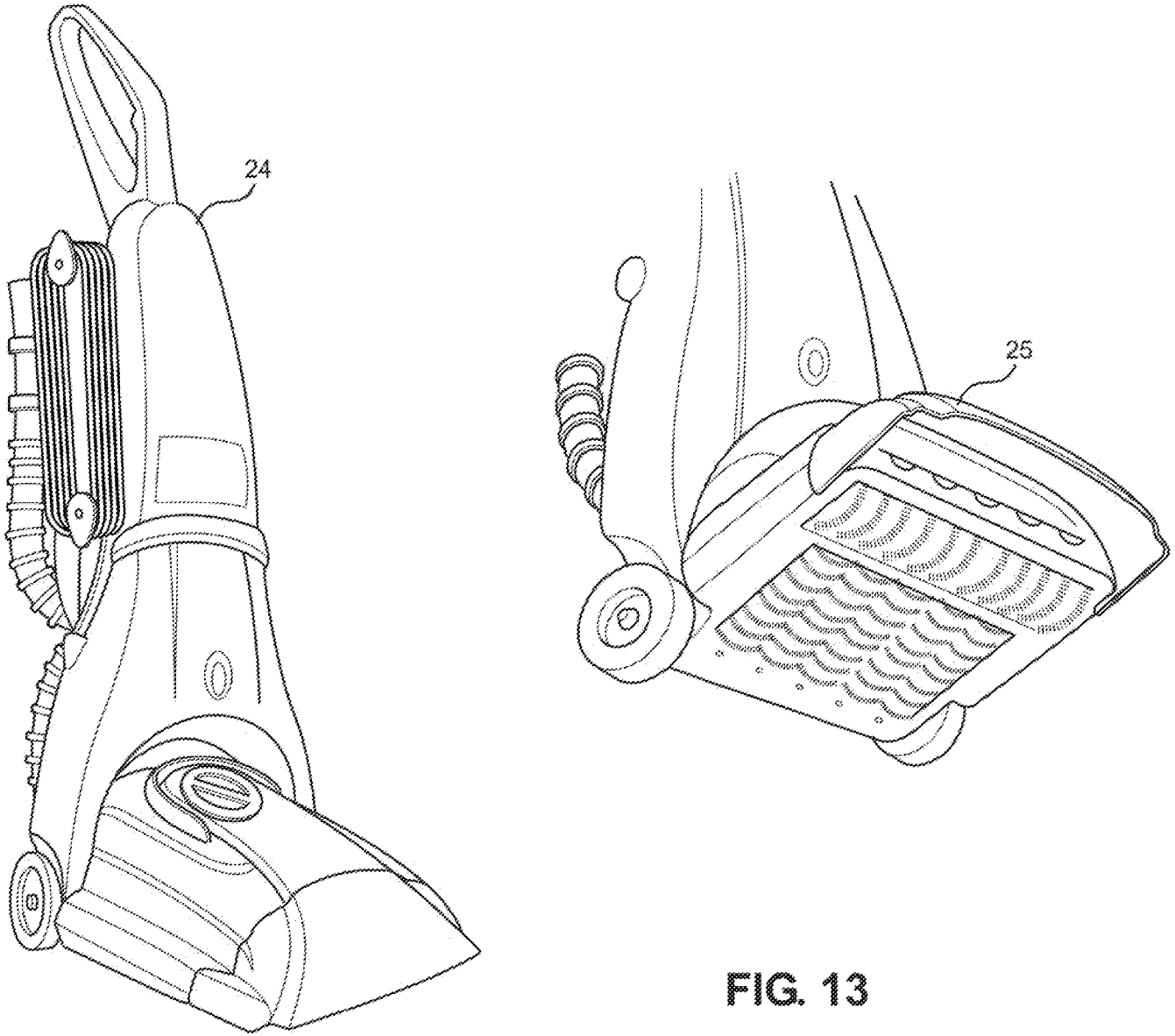
FIG. 13 illustrates an example embodiment showing an upright view of a steam cleaner and a bottom brush array view.

In the case of a steam cleaner (See items 24 & 25, FIG. 13), the implementation can be similar to the design described above with the new brush ensemble installed. The water can be sprayed into the carpet and sucked up with the same general process. The improved steam cleaner will employ our new brush operating process and arrangement to scrub carpet.

Some alternate designs include the following:

1. Have one or more brushes only spin one direction with a separate brush or set of brushes changing rotation direction based on whether the machine is moving forwards or backwards, in the same cleaning head or unit.
2. Brushes can be suction or air powered with air diverter or blower that can switch back and forth from one side of the brush to the other, to change the rotation of the brushes. The air diverter or blower switch would change based on the forwards or backwards motion of the machine.
3. One brush or one brush array (grouping of brushes) that changes brush rotation direction based on the forwards or backwards movement of the machine. Simultaneously the entire brush or brush array rotates horizontally and changes rotation direction based on travel path of motion forwards or backwards of the machine. For example, when the machine is traveling forward, the brush or brush array is rotating horizontally to the right and when the machine is traveling backwards the brush or brush array starts rotating to the left. Alternatively, the entire brush or brush array can rotate only one direction while the brushes still change rotation direction based on machine direction of travel. Any combination of applications mentioned, of vertically or horizontally rotating brushes or apparatuses, combination of rotation changing brushes and single direction brushes and entire brush or apparatus rotation changing based on the direction of travel of the machine, will constitute the same concept of this invention. All mentioned application arrangements in no way are stating limitations to this design. Any parameter combination would still constitute the same design as the example embodiments disclosed herein.
4. The direction changing brush, brushes or brush array, can move up or down in elevation, to change brush depth, if necessary.

Figure 6:
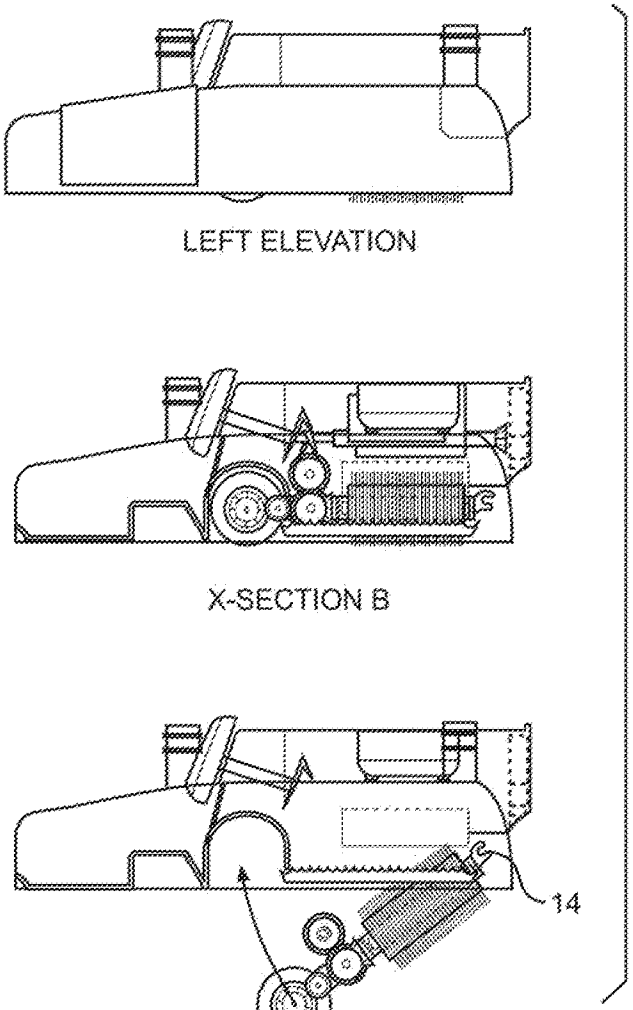
FIG. 6 illustrates an example embodiment showing an attachment bar.
Figure 8:
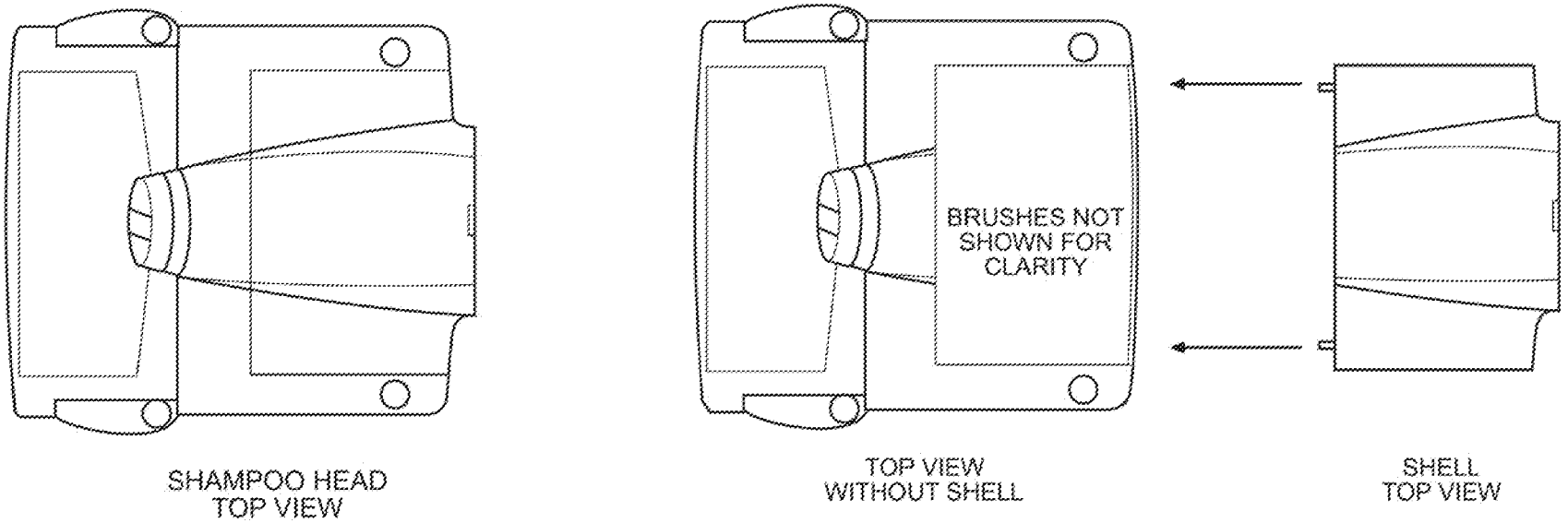
FIG. 8 illustrates an example embodiment showing a top view of the shampoo head and shell.
Figure 9:
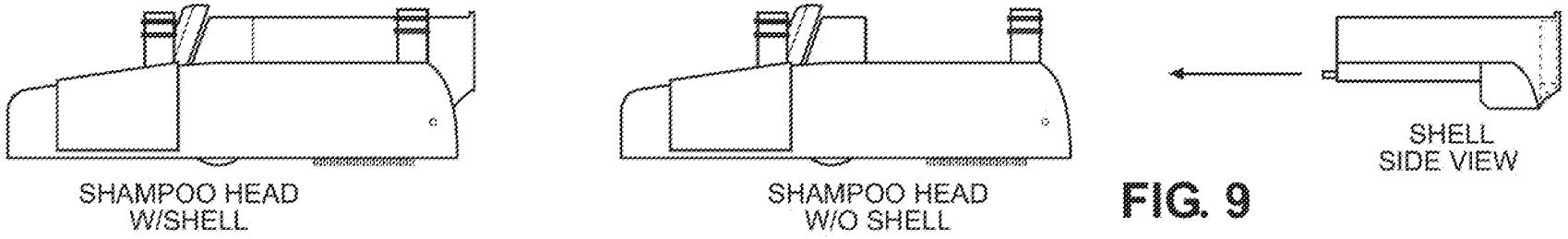
FIG. 9 illustrates an example embodiment showing a side view of the shampoo head and shell.

In the case of improving a conventional circular dry foam shampooer, the improvement may require a bit more redesign to accommodate all new parts. The existing head can have a lower frame that extends to the rear. The back rail of the frame running parallel to the belt lifter can have attachment bars (See item 14, FIG. 6) or holes for the attachment hooks (See item 26, FIG. 12), on the rear of the brush array to which to connect. The brush array can be inserted from underneath and angled with the hooks elevated and the opposite side lower so once the attachment hooks are connected to the frame, the front swings up into the head with the connectors on the outer edge of the long brush fitting into their connection cups. Once inserted, the tension of the belt between the spindle gear off the idler arm and the output spindle of the transmission or motor, holds the brush array into the shampooer head. Around the brushes can be troughs (See item 20, FIG. 12) running the length of each side of each brush, the same as the existing blade on the front of the existing brush. These blades help remove sand, dirt and moisture from the brushes as the cleaning process takes place. They are needed on both sides of the brushes; because, the brushes change direction of rotation. The troughs will need to be sloped from side to side and from back to front, to make sure the water all drains to the empty tray properly.

Figure 4:
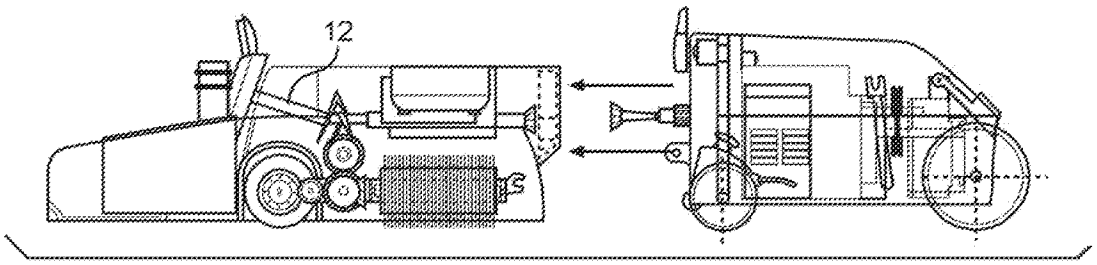
FIG. 4 illustrates an example embodiment showing a belt lifter.
Figure 5:
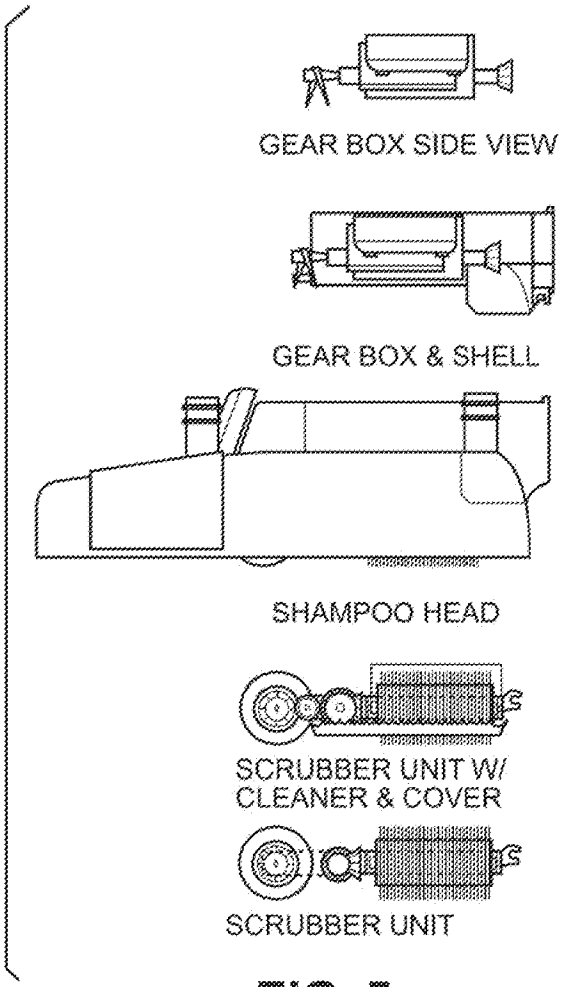
FIG. 5 illustrates an example embodiment showing a gear box and scrubber unit.

The belt is attached by inserting the brush array, wrapping the belt around the idler arm spindle gear, and using the belt lifter (See item 12, FIG. 4) to pick up the belt. The transmission or motor shell is then slid into place, riding on preformed tracks in the center portion of the lower frame, until the front of the shell abuts the rear of the belt lifter housing, enabling insertion of the attachment dowels (See item 11, FIG. 3) at the outer edge of the shell, into their attachment holes on the back of the existing shampooer head. The removing and attaching of the transmission/motor shell can happen without having to remove the soap bottles. At the same time, the drive/output spindle from the transmission or motor, slides underneath the belt putting it into position for the belt lifter to lower the belt onto the drive/output spindle. The latches (not illustrated) on the back of the lower frame are activated to attach the rear of the transmission/motor shell to the base frame. Now, the machine is assembled and ready to go. The transmission/ motor shell can have a handle (not illustrated) on the top for easy pickup, removal, and installation. The rear of the transmission/motor shell will retain the shape of the rear of the existing shampooer to attach to the power plant.

Figure 11:
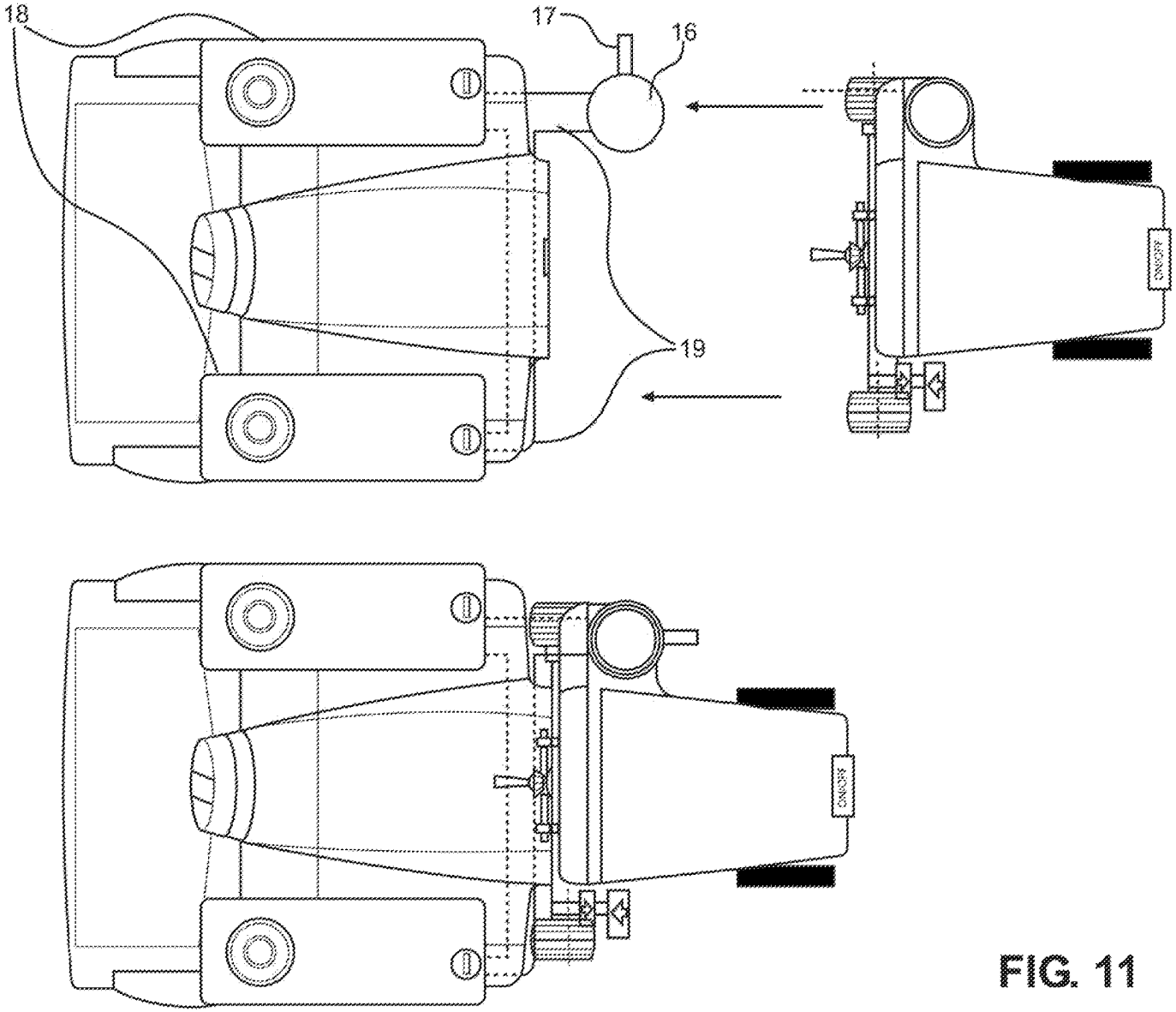
FIG. 11 illustrates an example embodiment showing the intake manifold, the intake manifold locking hand lever, the soap tanks, and the air intake distribution tubes.

In an effort to simplify use of the shampooer, an example embodiment can be made into a one piece unit that connects to the power plant in one motion, instead of three separate pieces that have to be separately installed. To do this, the machine can still have only one tank, but to allow it to carry more soap, the machine can be upgraded to have two onboard soap tanks (See item 18, FIG. 11) that can have button quick release connections. This also gives the user the ability to only fill one tank if only a small area is being cleaned. The two tanks can sit in a frame saddle that is attached to the frame base, having a manifold (See item 16, FIG. 11) that attaches to the blower port and splits with a tube (See item 19, FIG. 11) going to each tank. The tanks would retain the existing on/off switch for easy use.

The soap tanks can also be connected with the illustrated option of a spring loaded push in lock in connection type, like a printer ink cartridge, which would remove the need for a saddle/frame to connect the soap tanks to the shampooer head. The soap bottles have two female receptacles or male spouts. One side is the air intake (See item 9, FIG. 2) and one side is the foam output port (See item 8, FIG. 2). This design may require some alignment dowels, or an alignment slot and protrusion on the tanks and the shampooer head (not illustrated), to support and protect the tanks and connectors from blows from the side. The tanks may also require a lock (not illustrated) that can be initiated once the tanks are push locked in, to prevent the tanks from accidentally being removed while in use. There may also be a need for a safety actuator that doesn't allow the power plant to turn on, if both tanks aren't installed, similar to the ones currently on the power plant.

When one tank is used up, the other tank can be turned on to continue shampooing. It can also be possible to have them both connected to a single on/off instead. The shampooer intake manifold connection, would need a lever (See item 17, FIG. 11), and clamp or automatic connection actuator, to connect to the power plant's blower port; because, the existing design has the soap tank being connected by twisting it onto the blower port.

With this new design, the shampooer head would essentially connect the same way by tilting the head, setting the attachment hooks onto the attachment bar, lean the head back and turn the attachment lever to lock the head on. Now, since the head and tanks are all one piece, after the user attaches the hooks on the bar and leans the head back, the intake manifold simultaneously lowers onto the blower port for connection in the same motion. This will greatly improve the ease of use of the shampooer head.

In some applications, a separate blower port, different than the existing one, may be required for connection. An air flow diverter may be required to change flow direction between ports, or an automatic opening and closing airlock, to introduce air flow once shampooer head is connected. This may be necessary in an application where the bag can stay connected to its own port, while the shampooer connects and disconnects to the secondary blower port.

The Cleaning Station

Currently, to clean the hair off of the brushes of the shampooer and clean above the brushes, the conventional shampooer has to be disassembled with the brush removed. In an effort to further simplify the shampooer cleaning process, we have designed a cleaning station (See item 27, FIG. 14) that eliminates the need to disassemble the shampooer. To use the cleaning station, the user would drive the shampooer over the edge of the cleaning station, with the shampooer in its highest height setting and lower the height setting down for the cleaning cycle once the shampooer is in position. Underneath each brush will be a cleaning brush with cutting implements to clean the hair off of the brushes.

Figure 14:
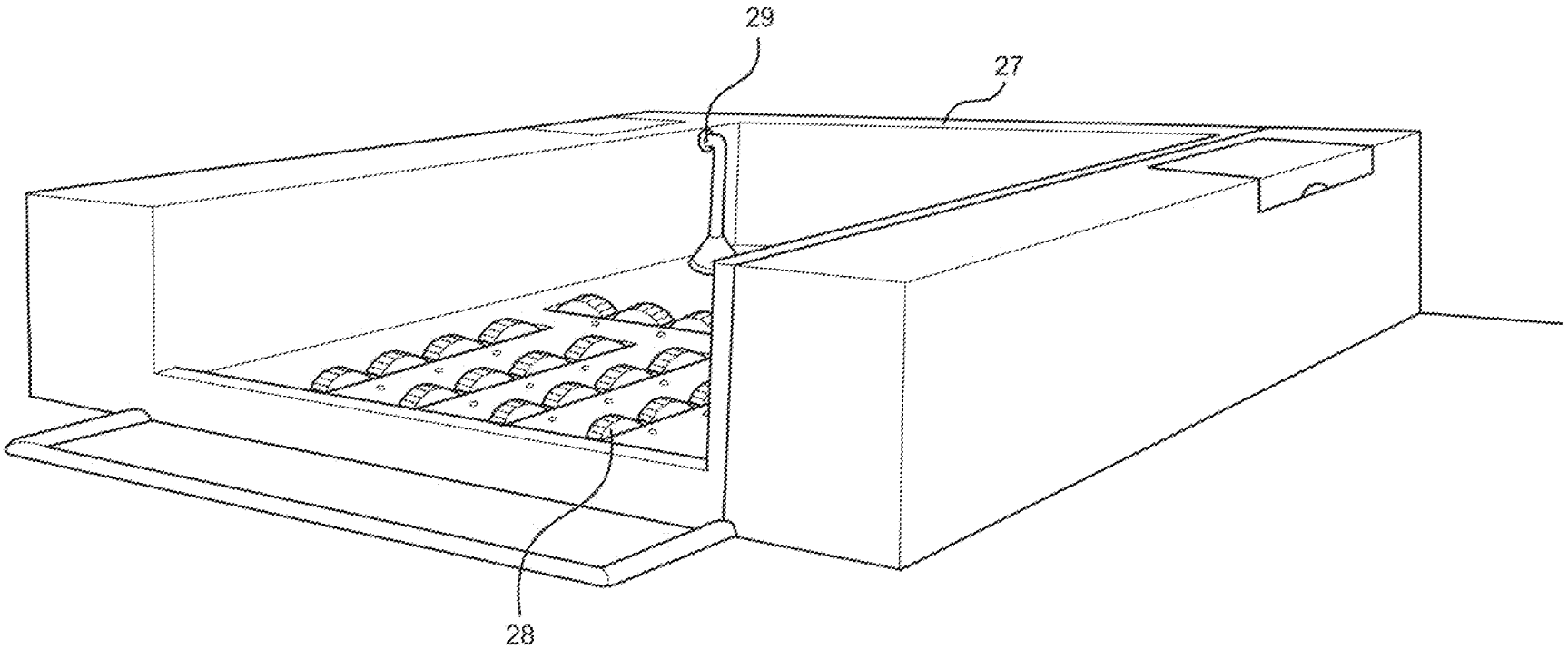
FIG. 14 illustrates an example embodiment showing a cleaning station, a hair grabber grinder system, and a sump tube.

In addition, the cleaning station hair removal apparatus below the brushes, can have a rotating hair grinding system (See item 28, FIG. 14) with fingers or protrusions that pull hair in, remove hair from the brush roll, grind up hair, and spit or release the ground-up hair into the water that will be sucked up by the sump (See item 29, FIG. 14). This way, the station is self-cleaning and won't require hair removal itself. In an example embodiment, the hair grinding system can be a rotating device that is combined or integrated into the hair grabbing bristles of the brush cleaning apparatus below the machine. The grinding device can also be the entire hair removing apparatus with no brush bristles (See item 28, FIG. 14). The hair grinder apparatus can also have scissor-like blades on the side of the wheels. The wheels can be offset and overlapping by halfway to create a scissor like motion as they rotate up against each other, which helps cut up the hair as it is pulled in (not illustrated). Additionally, the grinding apparatus can have a built-in beater bar (not illustrated) that agitates the brush roll to remove unwanted sand and grit.

At the same time that the brushes are having the hair removed, there can be an assortment of spray nozzles (not illustrated) spraying water and soap up inside the shampooer, to clean out any debris from the brush housings and the water troughs around the brushes. It should have a rinse cycle once soap has been sprayed. There can also be a sump to pump the waste water into a removable tank, into the front tray of the shampooer head, or plumbed into the house to drain directly into the sewer. This way, the cleaning station doesn't have to be awkwardly carried to be emptied for cleaning when it is full of water.

The wastewater empty tray/receptacle can drain directly into the cleaning station by manually opening a valve or an actuator operated valve to automatically drain during the cleaning cycle, so that the water is released and removed with the rest of the machine's cleaning wastewater. Also, the cleaning station can spray water into the wastewater tray/receptacle and around itself, to clean out dirt and grime during the cleaning cycle.

Also, the cleaning station can have a water fill level operated by a float or sensor, so that the station can fill up with enough water for the brushes to be partially submerged and be themselves cleaned, while spitting water into the channels above, onto the upper shields and even into the waste water tray, simultaneously cleaning all parts and avoiding most need of spray nozzles.

The Cleaning Cycle

Once the shampooer is parked in position in the cleaning station, a sensor or actuator activates a preprogrammed cleaning cycle. This starts water and/or soap sprayers, and/or a water fill level and a hair grinder/remover, if applicable. Completion is signaled by an indicator light and or a sound signal, when the cleaning cycle is complete. When the shampooer is parked in position in the cleaning station, the shampooer does not suction to the cleaning station for the cleaning process to happen. Instead, the shampooer is suspended above the base, de-hairing apparatus and spray nozzles for the cleaning process to take place. The shampooer can stay in the cleaning station, connected or disconnected from the power plant, when not in use, using the cleaning station as a drip pan. The cleaning station can also have a sensor that detects if all of the hair is removed from the brush roll. Using this sensor, it is possible to extend or reduce the length of the cleaning cycle, as needed. Once the cleaning cycle is complete, the cleaning station can signal the power plant to cause the cleaning station to shut down.

Alternatively, the cleaning station can be a wash basin area into which a user can submerge the lower brush portion of the shampooer, to clean and de-hair the brushes, once the attachment has been removed from the power plant. Once the attachment is installed into the basin, either a manually or automatically activated wash cycle can commence to clean the shampooer attachment, grind up hair, release the ground hair into the water, and sump out water into a removable waste water tank for dumping or emptying directly into the house's is sewer system. The basin can spray some water and self-clean once the shampooer head is removed. Then, once the cleaning cycle is complete, the shampooer is ready for storage.

Brush Roll Housing Cleaning Brush

Another example embodiment is provided herein to make the cleaning process of the shampooer and various other types of cleaning apparatuses possible. This example embodiment is the brush roll housing cleaning brush (See items 21 & 22, FIG. 12). The brush roll housing cleaning brush is a horseshoe or cavity-shaped brush that has upward facing bristles. The brush has an attachment and sliding implement on each side of the housing. This brush runs above the brush roll, by sliding back and forth from side to side, with its bristles brushing the cavity above the brush roll cleaning off the grime. The brush roll housing cleaning brush can function in various ways described as follows:

1. Staying at the outside edge of the brush roll during shampooing and being swiped back and forth manually with a lever, while running some water into the housing, after shampooing is complete and head is removed, to clean dirt out. If the shampooer is a stand-alone unit, then it can just be flipped over to clean.
2. The brush roll housing cleaning brush can have a mechanism on the cleaning station that connects to the housing brushes and swipes them back and forth while the cleaning cycle is running.
3. The brush roll housing cleaning brush can be set up to automatically run constantly while the shampooer is running, constantly swiping the brush roll housing keeping it clean. This can be accomplished in multiple ways as described below:
   a. A mechanical or electric piston can be provided that pushes and pulls each of the two brushes back and forth against the brush roll cavities continuously.
   b. The brush roll housing cleaning brush can employ a mechanism similar to train propulsion having a gear running off our already spinning brush gears, with an arm connected to the brush and pivotally at one point on the gear pushing and pulling the brush back and forth as the gear spins. In this application, the long brush cavity may require two brushes, one on each side to reach all the way across. Both the long brush and short brush cavity brushes may require their own propulsion gearing since they move in opposing directions.
   c. The brush roll housing cleaning brush can use a worm drive gear for each of the two brushes, running off the brush array gears or a motor, that would swipe the brush one way when the machine travels forward and when the brush roll and worm drive rotation changes as the machine starts to travel backwards, the brushes would swipe the other direction.
   d. The shampooer can create suction through added ducts on each side of the two cavity brushes, with an actuator opening the suction port on the opposite side of the cavity as the brush putting suction into the slide track air ducts sucking the brush over. Then, the actuator would close this suction port and open the one on the other side, to suck the brush back to the other side. The suction port changing actuator can run off the same actuator that changes brush direction based on motion of the machine, or it can activate the suction port change every time the brushes reach one side or the other making a continuous cleaning motion.
   e. Implementations "c" and "d" described above can be combined, as suction to propel worm drive gears with suction ports oriented to propel the worm drive gears both required directions, using actuators to change suction ports, gear direction of rotation and brush swipe direction.

This brush roll housing cleaning brush as described herein can be implemented in shampooers, vacuums, and various cleaning devices. It may also have applications other than cleaning devices.

SHAMPOOER ITEM REFERENCE LEGEND

Item 1—Spindle Gear
Item 2—Idler Arm
Item 3—Original Long Brush Roll and Set of New Short Brush Rolls.
Item 4—Bevel Gear and Drive Input Shaft
Item 5—Transmission
Item 6—Brush Array Frame Rail (Entire Brush Array Unit)
Item 7—Belt
Item 8—Foam Output Port from Soap Bottle
Item 9—Air Intake Port to Soap Bottle
Item 10—Transmission/Motor Shell
Item 11—Attachment Dowels
Item 12—Belt Lifter
Item 13—Gap Spanning Gear
Item 14—Attachment Bar
Item 15—Mechanical Actuation Arm
Item 16—Intake Manifold
Item 17—Intake Manifold Locking Hand Lever
Item 18—Soap Tanks
Item 19—Air intake Distribution Tubes
Item 20—Brush Cleaning Waste Water Troughs
Item 21—Brush Roll Housing Cleaning Brush (Long Brush)
Item 22—Brush Roll Housing Cleaning Brush (Short Brushes)
Item 23—Drive Spindle
Item 24—Upright View Steam Cleaner
Item 25—Bottom Brush Array View
Item 26—Attachment Hooks
Item 27—Cleaning Station
Item 28—Hair Grabber Grinder System
Item 29—Sump Tube The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used only for descriptive purposes and not to be construed as limiting. The elements, materials, geometries, dimensions, and sequence of operations may all be varied for particular applications. Parts of some embodiments may be included in, or substituted for, those of other embodiments. While the foregoing examples of dimensions and ranges are considered typical, the various embodiments are not limited to such dimensions or ranges.

The Abstract is provided to allow the reader to quickly ascertain the nature and gist of the technical disclosure. The Abstract is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

What is claimed is:

1. A four-direction carpet shampooer comprising:

a single first brush roll configured to rotate on a first axis, the first brush roll being parallel with a front edge of a shampooer head and perpendicular to a forward and backward direction of travel of the shampooer, the first brush roll extending a substantial length across the shampooer head;

a plurality of second brush rolls configured to rotate on parallel second axes, the plurality of second brush rolls including three or more brush rolls, the parallel second axes being transverse to the first axis and parallel with the forward and backward direction of travel of the shampooer, the plurality of second brush rolls extending the substantial length across the shampooer head, each of the plurality of second brush rolls having bristles attached directly thereto around an entire circumference of each brush roll, wherein two adjacent sides of carpet fibers being in contact with the single first brush roll and the plurality of second brush rolls across the substantial length of the shampooer head during a single pass of the shampooer in the forward direction of travel, wherein two opposite adjacent sides of the carpet fibers being in contact with the single first brush roll and the plurality of second brush rolls across the substantial length of the shampooer head during a single pass of the shampooer in the backward direction of travel;

a direction of travel sensor to detect the shampooer direction of travel; and a rotation changing actuator configured to reverse the rotation of the first brush roll on the first axis and to reverse the rotation of the plurality of second brush rolls on the parallel second axes when the direction of travel sensor indicates the forward or backward direction of travel of the shampooer has changed, the four-direction carpet shampooer thereby configured to clean two adjacent sides of carpet fibers when traveling forward and to clean the remaining two opposite sides of the carpet fibers when traveling backwards, thereby cleaning all four sides of the carpet fibers with one forward and one backward pass over the carpet fibers.

2. The four-direction carpet shampooer of claim 1 wherein the first roll and the plurality of second brush rolls are brush arrays.

3. The four-direction carpet shampooer of claim 1 wherein the first roll and the plurality of second brush rolls are propelled by one idler arm from one belt.

4. The four-direction carpet shampooer of claim 1 wherein the first roll and the plurality of second brush rolls are propelled using a device from the group consisting of: a transmission, a motor, an air diverter for suction, and an air blower.

5. The four-direction carpet shampooer of claim 1 being further configured with an idler arm and gear damper to protect gears and reduce gear noise.

6. The four-direction carpet shampooer of claim 5 being further configured with an extra spindle gear above the idler arm to facilitate belt installation without brush disassembly.

7. The four-direction carpet shampooer of claim 1 wherein the direction of travel sensor is a device of a type from the group consisting of: a mechanical device, an electrical device, a computerized device, and a motion sensor.

8. The four-direction carpet shampooer of claim 1 being further configured with a brush roll housing cleaning brush.

9. The four-direction carpet shampooer of claim 8 wherein the brush roll housing cleaning brush is a horseshoe or cavity-shaped brush having upward facing bristles.

10. The four-direction carpet shampooer of claim 8 wherein the brush roll housing cleaning brush is configured to automatically run while the shampooer is running.

11. The four-direction carpet shampooer of claim 8 wherein the brush roll housing cleaning brush is propelled by a worm drive gear or a suction port.

12. The four-direction carpet shampooer of claim 1 being further configured with the shampooer head and a soap bottle integrated in one component.

13. The four-direction carpet shampooer of claim 1 being further configured with dual soap tanks.

14. The four-direction carpet shampooer of claim 1 being further configured with a manifold attached to the shampooer head allowing installation of the shampooer head to be performed in one motion.

15. The four-direction carpet shampooer of claim 1 being further configured with a transmission/motor shell, wherein the transmission/motor shell is configured as a separate removable component from the shampooer head.

* * * * *